US006868808B2

(12) United States Patent
Brünemann et al.

(10) Patent No.: US 6,868,808 B2
(45) Date of Patent: Mar. 22, 2005

(54) DEVICE FOR LIQUEFICATION OF VAPOROUS FUEL FRACTIONS IN FUEL TANKS

(75) Inventors: Ralf Brünemann, Stuttgart (DE); Eberhard Holder, Kusterdingen (DE); Roland Kemmler, Stuttgart (DE); Martin Matt, Bruchsal-Untergrombach (DE); Lothar Mauz, Esslingen (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 10/256,259

(22) Filed: Sep. 27, 2002

(65) Prior Publication Data

US 2003/0070630 A1 Apr. 17, 2003

(30) Foreign Application Priority Data

Sep. 28, 2001 (DE) ..... 101 48 057

(51) Int. Cl.[7] ..... F02B 75/12
(52) U.S. Cl. ..... 123/3; 123/518
(58) Field of Search ..... 123/3, 518, 23, 123/533, 576, 557, 558, 575, 525, 509, 516, 541; 141/65, 94, 192

(56) References Cited

U.S. PATENT DOCUMENTS

| | | | | | |
|---|---|---|---|---|---|
| 2,682,752 | A | * | 7/1954 | Branson | 137/314 |
| 3,367,120 | A | * | 2/1968 | Franklin | 62/3.2 |
| 3,794,000 | A | * | 2/1974 | Hodgkinson | 123/557 |
| 3,831,353 | A | * | 8/1974 | Toth | 96/144 |
| 4,671,071 | A | * | 6/1987 | Sasaki | 62/47.1 |
| 5,255,735 | A | * | 10/1993 | Raghava et al. | 165/111 |
| 5,957,113 | A | * | 9/1999 | Masaki et al. | 123/518 |
| 6,694,955 | B1 | * | 2/2004 | Griffiths et al. | 123/516 |

FOREIGN PATENT DOCUMENTS

DE 199 27 177 7/2000

* cited by examiner

*Primary Examiner*—Tony M. Argenbright
*Assistant Examiner*—Katrina Harris
(74) *Attorney, Agent, or Firm*—Crowell & Moring LLP

(57) ABSTRACT

A device for liquefying fuel fractions which are in vapour form in fuel tanks (1), having a suction device (10), a pump (13), a condensation device (16) and a separation and storage device (18). This device has a regulation device, with the aid of which the fraction-air mixture (31), which is displaced by the fuel (30), flowing in during the refuelling of the fuel tank (1) and/or a fraction-air mixture (31) which is produced by air injection by means of an air-injection device (23) can be sucked out and separated.

9 Claims, 2 Drawing Sheets

DEVICE FOR LIQUEFICATION OF VAPOROUS FUEL FRACTIONS IN FUEL TANKS

This application claims the priority of German Application No. 101 48 057.1, filed Sep. 28, 2001, the disclosure of which is expressly incorporated by reference herein.

BACKGROUND AND SUMMARY OF THE INVENTION

The invention relates to a method for separating a low-boiling fuel fraction out of a liquid fuel and to the aerating and venting of fuel tanks of motor vehicles.

A fuel fractionation device is already known from German Patent DE 199 27 177 C1, for separating a low-boiling fuel fraction from a liquid fuel for an internal combustion engine, having a tank which contains the liquid fuel. By sucking out gas, the fuel fractionation device generates a vacuum in the tank and sucks the low-boiling fuel fraction in vapour form out of the tank, making it available to the internal combustion engine. The vacuum is generated by sucking out air by means of the internal combustion engine. To improve the efficiency of fractionation, a carrier-gas feed is provided which introduces a carrier gas into the liquid fuel in the tank, the carrier gas being sucked out of the tank together with the fuel fraction in vapour form. The mixture which is sucked out is either fed to the internal combustion engine or the fuel fraction is separated and is preferably collected in the liquid state. In this case, the carrier gas is introduced into the fuel again.

The invention is based on the object of designing and arranging devices for fuel tanks of motor vehicles in such a manner that the fuel tanks can be refuelled in a more environmentally friendly manner, are more reliable in terms of safety and are easy to test.

According to the invention, the object is achieved by providing a device for fuel tanks for sucking out and condensing fuel fractions in vapour form and for injecting carrier gas, such as fresh air, into the fuel in the fuel tank which is suitable for generating excess pressure and vacuum in the fuel tank.

The excess pressure, which can be regulated by means of a control and can be measured by means of a pressure sensor, is generated by injecting fresh air by means of a pump. The vacuum, which can likewise be regulated by means of a control and measured by means of a pressure sensor, is generated by sucking fraction-air mixture out of the fuel tank by means of a pump.

The device is fixedly installed in a motor vehicle, and by means of the pump a regulated excess pressure is produced in the fuel tank by injecting fresh air or a regulated vacuum is produced in the fuel tank by sucking out fraction-air mixture. The measured pressure is recorded by a control unit and evaluated by a control logic. With the aid of a level detector, the fraction-air mixture which has been displaced by the fuel flowing in when the fuel tank is being refuelled is sucked out and does not pass either into the extraction pipe of the fuel nozzle or into the atmosphere.

Likewise, when air is injected by means of an air-injection device in order to generate a fraction-air mixture, the latter can be sucked out and separated at any time in a regulated manner by means of the control and the pump. The condensed fuel fraction is fed in a regulated manner to an internal combustion engine.

According to a refinement, the device has a three-way or multiway valve which can be regulated by means of a control unit and a control logic and has at least one outlet (A) and at least one outlet (B). The three-way or multiway valve combines the regulating device for sucking out the fraction-air mixture, which has been displaced by the fuel flowing in and produced by injection, with the device for generating vacuum and excess pressure. In this context, it is advantageous that the multiway valve is connected downstream of the delivery side of the pump.

Furthermore, it is advantageous for the multiway valve at the outlet (A) to have a first line system with a regulator I, by means of which an air circuit for injection can be regulated. A second line system, which is in communication with the first line system, has a regulator II, by means of which the onward passage of air into a filter device can be regulated. Therefore, depending on the control, the air which has been separated from the fraction is either passed into the air circuit in order to generate a low-boiling fraction or into the atmosphere via a filter device.

To generate a low-boiling fuel fraction, it is advantageous that the fraction-air mixture, by means of the suction device, is successively fed to the pump, the condensation device and the separation and storage device, and then, by means of a regeneration valve, the fraction is fed in a regulated manner to an internal combustion engine and the air is fed to the filter device or the air-injection device. The filter device is in communication, via an inlet device and a guide device, with the interior of the fuel tank, and via an outlet device and a regulatable valve I, with the atmosphere.

According to a preferred embodiment of the invention, a third line system is connected to the outlet (B) of the regulatable multiway valve. This third line system is used to generate, hold and reduce the pressure difference. For this purpose, it is in communication, via the filter device, with the atmosphere and, via a regeneration valve, with the internal combustion engine. The connection to the atmosphere has a regulator III and a bypass line which has a regulatable valve II and bypasses the regulator III.

The build-up of the excess pressure with fresh air is controlled by the regulator III and the regulatable valve II. After the excess pressure has been built up, the leakage is determined by means of a pressure sensor and a control. The excess pressure is reduced after the measurement as a result of the filter device or the regeneration valve being opened.

For the present invention, it is of particular importance that, in order to build up the vacuum, the fraction-air mixture is fed to the internal combustion engine via the regeneration valve. To reduce the vacuum, the regulatable valve at the filter device is opened, in order to create a balance with the atmosphere.

In connection with the inventive design and arrangement, it is advantageous to allow the inventive testing of fuel tanks by generating excess pressure by means of a method which simultaneously ensures that the filter device is cleaned. The filter device of fuel tanks for motor vehicles is part of the device which is fixedly installed in the motor vehicle.

In the fuel tank, excess pressure is built up by directly sucking in fresh air or by sucking in fresh air via the filter device. The filter device is regenerated while the fresh air is being sucked in via the filter device. After a regulated and measured excess pressure has been built up, the drop in the excess pressure over the course of time, as a result of leakage from the fuel tank, is measured and evaluated. The pressure is measured by means of a pressure sensor. The excess pressure which still exists in the fuel tank after the measurement is reduced by passing fraction-air mixture to an internal combustion engine in a regulated manner or, when the internal combustion engine is stationary, by passing the fraction-air mixture into the atmosphere via the filter element.

Furthermore, it is advantageous that a) the vacuum is built up by suction out of the fuel tank and passing fraction-air mixture on to an internal combustion engine in a regulated manner, b) after the defined and/or measurable vacuum has been built up, the drop in the vacuum over the course of time as a result of leakage is measured and evaluated, c) the vacuum which is still retained after the measurement is reduced by sucking in fresh air directly or by sucking in fresh air via the filter device in the fuel tank. The filter device is regenerated by the fresh air flowing through it.

Moreover, it is advantageous to allow the inventive sucking-out of the fraction-air mixture, which has been displaced during the refuelling of fuel tanks in motor vehicles, by means of a method which is also used to generate a low-boiling fraction for the starting operation by means of a device which is fixedly installed in the motor vehicle.

The initiation of a refuelling operation of the fuel tank is recognized by a sensor. The pump sucks out at least the fraction-air mixture which has been displaced by the fuel flowing in during refuelling. The fraction-air mixture is separated into fraction and air, and the fraction is liquefied, stored and fed to the internal combustion engine in a regulated manner when required. The air is expanded and passed on to atmosphere via a filter device. Alternatively, the air, after it has been expanded, if the fuel tank is closed, is injected back into the fuel in order to generate a light fuel fraction.

Other objects, advantages and novel features of the present invention will become apparent from the following detailed description of the invention when considered in conjunction with the accompanying drawings.

BRIEF DESCRIPTION OF THE DRAWINGS

Further advantages and details of the invention are explained in the description and are illustrated in the figures, in which:

FIG. 1 diagrammatically depicts an exemplary embodiment of the device according to the invention which is suitable both for the fractionation of highly volatile starting fuel 33 and for the liquefaction of fuel vapours during refuelling. A first line system 11 and a second line system 12 extend from a pump 13.

Figure 1:
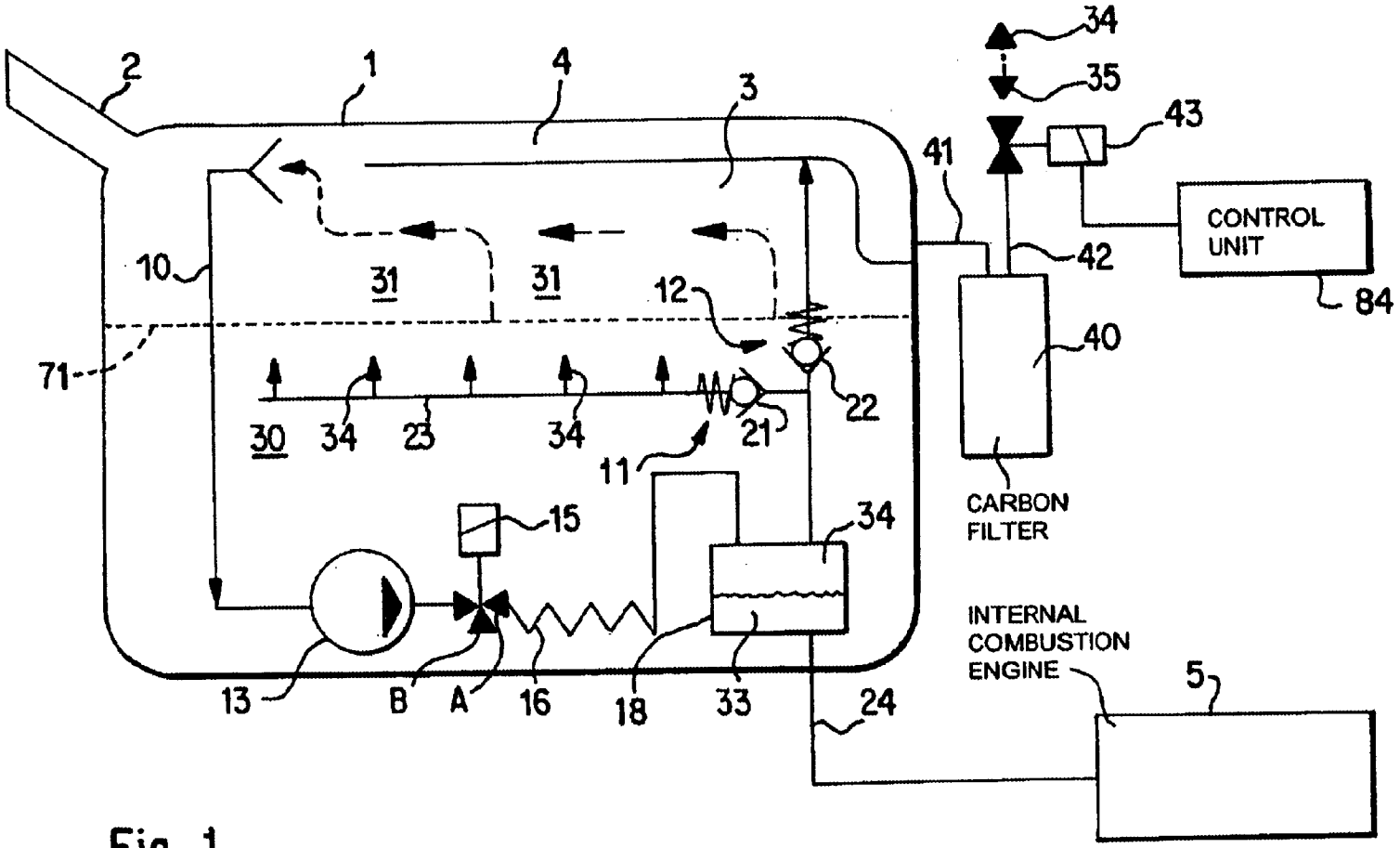
FIG. 1 diagrammatically depicts a device according to the present invention for fractionation of volatile fuel and liquefaction of fuel vapours.

A fuel tank 1 is illustrated with a closable tank connection piece 2. A fraction-air mixture 31 is situated in a vapour space 3 of the fuel tank 1, which is filled with liquid fuel 30 up to a filling level 71. The fraction-air mixture 31 is formed by low-boiling fuel 30. Via a passage 4, the interior of the fuel tank 1 is connected to an activated carbon filter 40. For this purpose, the outer wall of the fuel tank 1 is connected to the housing of the activated carbon filter 40 via an inlet line 41. In the housing of the activated carbon filter 40 there are one or more filter elements with activated carbon as the filter material. The housing of the activated carbon filter 40 is connected to atmosphere via an outlet line 42 and a solenoid valve I 43. The solenoid valve I 43 is regulated by means of a control unit 84.

Using a suction device 10, the fraction-air mixture 31 is sucked out and compressed by means of the pump 13. At a certain degree of compression, the outlet A of a regulatable three-way valve 15 is opened by means of the control. The outlet B of the regulatable three-way valve 15 remains closed. The compressed fraction-air mixture 31 then flows through a cooler of a condensation device 16, which releases the heat of compression to the fuel in the fuel tank 1. The fractionation is facilitated by the dissipation of the heat of compression to the fuel 30.

A large proportion of the volatile fuel components condenses in a separation and storage device 18 to form starting fuel 33. The starting fuel 33, which is then in liquid form, is stored in the separation and storage device 18, in an additional tank with integrated level-measuring device. The liquid starting fuel 33 is fed via a starting-fuel line 24 in order to start a cold internal combustion engine 5.

Depleted air 34 is expanded to the pressure level in the fuel tank 1 at a pressure-relief valve I 21 and passes back into the liquid fuel 30 via an air-injection device 23 designed as a distributor. As it rises, the air 34 is preferably enriched again with highly volatile fuel components and forms the fraction-air mixture 31. The mixture is sucked out again. The cycle described begins again from the start.

Any required pressure compensation in the fuel tank 1 is effected as a result of fresh air 35 flowing in or air 34 flowing out via the activated carbon filter 40. In the case of compensation for a vacuum, the fresh air 35 flowing into the fuel tank 1 is enriched with fuel fraction in the activated carbon filter 40 and is guided into the fuel tank 1 within the passage 4. The passage 4 ends just before the suction point of the suction device 10. This ensures that no ignitable mixture is formed in the fuel tank 1 during the fractionation.

In a further configuration, a control unit recognizes that the refuelling operation has been initiated. This can be recognized, for example, from the signal from a level-measuring device or by means of a pressure switch. Therefore, the operation of sucking out the fraction-air mixture 31 which has been displaced by the fuel 30 flowing in during the refuelling operation is initiated. The pressure switch makes use of the effect that, when the tank closure is opened, the pressure in the fuel tank 1 changes suddenly. When the refuelling operation is recognized, the control unit switches on the pump 13. This sucks the fraction-air mixture 31 comprising fuel vapour and air 34, which has been displaced by the refuelling operation, out of the vapour space 3 of the fuel tank 1 and compresses this mixture. The open tank connection piece (not shown) is in this case advantageously sealed with respect to the fuel nozzle (likewise not shown) by means of a rubber ring.

For this purpose, at the regulatable three-way valve 15, the outlet A is open and the outlet B is closed. The suction capacity of the pump 13 is designed for the maximum volumetric flow rate of fuel from a fuel nozzle. The compressed fraction-air mixture 31 adjoining the regulatable three-way valve 15 then flows through the cooler, which dissipates the heat of compression to the fuel in the fuel tank 1. In the process, a large proportion of the highly volatile fuel components is condensed to form starting fuel 33. The liquid starting fuel 33 is stored in an additional tank of the separation and storage device 18. Then, the depleted air 34 is expanded to the pressure level in the fuel tank 1 at a pressure-relief valve II 22. The depleted air 34 passes into the passage 4, which passes it on into the activated carbon filter 40, where it is completely cleaned and escapes to the environment via the open solenoid valve I 43.

The passage 4 prevents the depleted air 34 from mixing with the fraction-air mixture 31. The starting fuel 33 stored in the separation and storage device 18 is used to start the cold internal combustion engine 5, in order in this way to reduce the emissions of exhaust gas. This device can significantly reduce the volume of the activated carbon filter 40 compared to the conventional method, since the displaced fraction-air mixture 31 is not filtered.

Figure 2:
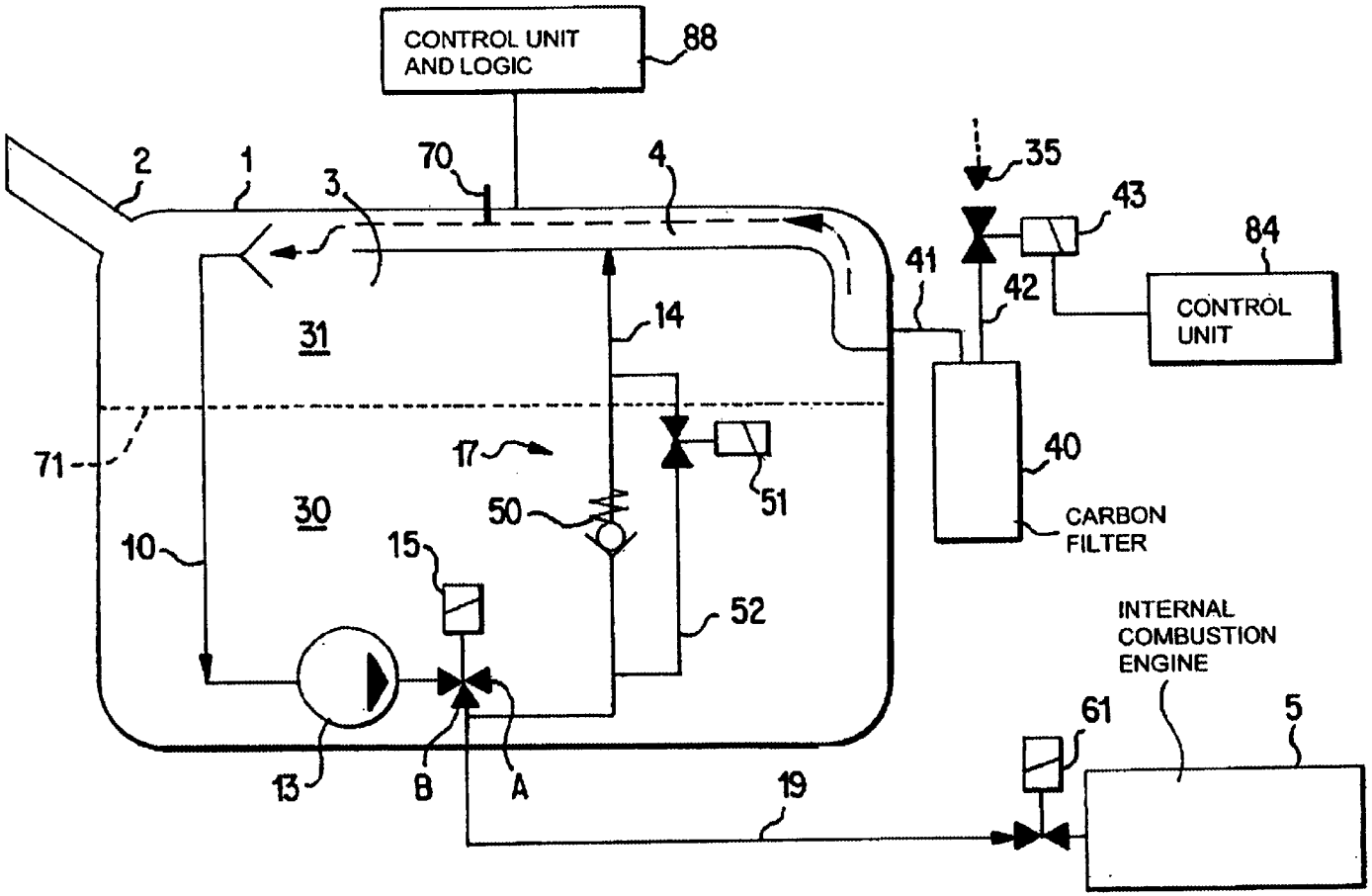
FIG. 2 diagrammatically depicts a device according to the present invention for regenerating a carbon filter and for leakage testing.

FIG. 2 diagrammatically depicts an exemplary embodiment of the device according to the invention which is suitable for regenerating an activated carbon filter 40 and for testing the leaktightness of a fuel tank 1 using excess-pressure or vacuum methods. For this purpose, a third line system, which includes a branch line 14, a bypass line 52 and a supply line 19, extends from the pump 13.

A sensor which detects the state of loading of the fuel-laden activated carbon filter 40 is used to regenerate the activated carbon filter 40. When the activated carbon filter 40 is fully laden, the pump 13 is switched on and the fraction-air mixture 31 is sucked out of the vapour space 3 of the fuel tank 1. For this purpose, at the regulatable three-way valve 15 the outlet A is closed and the outlet B is open. The pressure in the fuel tank 1 drops slightly, so that fresh air 35 passes from the environment into the fuel tank 1 via the activated carbon filter 40 when the solenoid valve I 43 is open. The fresh air is enriched with fuel fraction in the activated carbon filter 40 and in this way regenerates the activated carbon filter 40. The enriched air passes via the passage 4 to the intake funnel of the suction device 10.

The positioning of passage end and intake funnel of the suction device 10 is selected in such a way that the enriched fresh air 35 does not mix with the fraction-air mixture 31 in the fuel tank 1, so that it is impossible for an ignitable mixture to form in the vapour space 3 of the fuel tank 1.

The delivery pressure of the pump 13 is limited by a pressure-relief valve III 50 in the branch line 14, which branches off downstream of the regulatable three-way valve 15, so that there is no unacceptable rise in pressure irrespective of the switching position of the engine-side regeneration valve 61. A solenoid valve II 51 in the bypass line 52 is closed. The minimum opening pressure of the pressure-relief valve III 50 is greater than the pressure drop in the activated carbon filter 40. With this device, the activated carbon filter 40 can be regenerated independently of the load and rotational speed of the internal combustion engine 5.

To test the leaktightness of the fuel tank 1 by means of vacuum, the pump 13 sucks fraction-air mixture 31 out of the vapour space 3 of the fuel tank 1 with the solenoid valve I 43 closed. In the process, a vacuum is formed in the fuel tank 1. For this purpose, at the regulatable three-way valve 15 the outlet A is closed and the outlet B is open. The pump 13 is switched off when the control unit and logic 88 recognizes a stipulated vacuum limit value in the fuel tank 1 by means of a pressure sensor 70. The fuel tank 1 is closed.

The pressure sensor 70 then measures the pressure change in the fuel tank 1 over the course of time. The fraction-air mixture 31 which has been sucked out passes via the regulatable three-way valve 15 to the open regeneration valve 61 into the suction module of the internal combustion engine 5.

To test the leaktightness of the fuel tank 1 using excess pressure, the pump 13 sucks fresh air 35 out of the environment via the activated carbon filter 40 with the solenoid valve I 43 open. For this purpose, at the regulatable three-way valve 15 the outlet A is closed and the outlet B is open. The regeneration valve 61 and the solenoid valve II 51 are closed. The enriched air is compressed until the response pressure of the pressure-relief valve III 50 is reached. Then, the pump 13 is switched off and the solenoid valve I 43 closed. The fuel tank 1 is likewise closed. The solenoid valve II 51 then opens in the bypass line 52, the previously compressed air expands and leads to an increase in pressure in the fuel tank 1. The solenoid valve II 51 closes when the control detects a set excess-pressure limit value in the fuel tank by means of a pressure sensor 70.

Then, the pressure sensor 70 measures the change in pressure in the fuel tank 1 over the course of time. The compression volume, formed by the line system between pump 13 and the valves, is designed in such a way that even at a low filling level sufficient excess pressure is formed in the fuel tank 1. After the leaktightness test has ended, the pressure compensation in the fuel tank 1 can take place optionally by opening the solenoid valve I 43 or the regeneration valve 61. With a short time delay, the regulatable three-way valve 15 also opens, so that the pressure in the fuel tank 1 is brought into line with the environment without the activated carbon filter 40 being laden.

The device shown in FIG. 1 and the device shown in FIG. 2 together form a device for fuel tanks 1 which is very versatile in use. Furthermore, the internal combustion engine 5 is connected to the fuel tank 1 via a main fuel line (not shown). The fuel 30 situated in the fuel tank 1 is fed to the internal combustion engine 5 via the main fuel line.

The lack of dependency on the intake pressure of the internal combustion engine 5 allows use in motor vehicles with direct injection, extreme boosting or start/stop devices.

The sucking out and condensing of the fraction-air mixture 31 displaced during refuelling allows the volume of the activated carbon filter 40 to be reduced. Furthermore, refuelling is made more environmentally friendly.

The possibility of testing the fuel tank 1 at any time by means of a pressure difference increases safety and creates on-board diagnosis.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A device for liquefying fuel fractions fed to an internal combustion engine which are in vapour form in fuel tanks, said device comprises:

an air-injection device;

a suction device;

a pump:

a condensation device;

a separation and storage device;

a pressure regulating device for sucking out and separating a fraction-air mixture as a, function of pressure, said fraction-air mixture being one of displaced by a fuel flowing in during refuelling of the fuel tank and produced by air injection.

2. A device adapted to be fixedly installed in a motor vehicle for sucking fuel fractions in vapour form out of a fuel tank, said device comprising:

a pump for providing one of a regulated excess pressure in the fuel tank by injecting fresh air and a regulated vacuum in the fuel tank by sucking out fraction-air mixture;

sensor means for measuring pressure in said fuel tank; and a control and logic unit for recording and evaluation said measured pressure.

3. The device according to claim 1, further including a three-way or multiway valve which is regulated by means of a control unit and a control logic and has at least one outlet (A) and at least one outlet (B), the three-way or multiway valve combining the regulating device for sucking out the fraction-air mixture which has been displaced by the fuel flowing in the produced by injection with the device for generating vacuum and excess pressure.

4. The device according to claim 3, wherein the three-way or multiway valve at the outlet (A) has a first line system with a regulator (I), by means of which an air circuit for injection can be regulated, and the device has a second line system which is in communication with the first line system and has a regulator (II), by means of which the onward passage of air into a filter device can be regulated.

5. The device according to claim 1, wherein the fraction-air mixture, by means of the suction device, is successively fed to the pump, a condensation device and a separation and storage device, and then a fraction is fed in a regulated manner to said internal combustion engine and the air is fed to a filter device or an air-injection device, the filter device being in communication, via an inlet device and a guide device, with the interior of the fuel tank, and via an outlet device and a regulatable valve with the atmosphere.

6. The device according to claim 4, wherein a third line system, which has regulator, which is used to generate, hold and reduce the excess pressure, and a bypass line, which has regulatable valve and bypasses the regulator, is connected to an outlet (B) of the regulatable three-way or multiway valve, a connection to atmosphere, which is in communication with the filter device and is used to build up the excess pressure, and a connection to the internal combustion engine, which is used to reduce the excess pressure, being provided, and the fuel tank having a pressure sensor.

7. The device according to claim 6, wherein the third line system, which is used to generate a pressure difference, has a suction device for the fraction-air mixture, which is used to build up the vacuum, with the fraction-air mixture being fed to the internal combustion engine via the regeneration valve and the third line system having a connection to atmosphere, which is used to reduce the vacuum.

8. A method for sucking out fraction-air mixture during the refuelling of fuel tanks for motor vehicles and/or for generating a fraction for the starting operation by means of a device which is fixedly installed in the motor vehicle, comprising the steps of:

recognizing the initiation of a refuelling operation of the fuel tank and sucking out at least the fraction-air mixture which has been displaced by the fuel (30) during refuelling;

separating the fraction-air mixture into fraction and air, and liquefying the fraction;

storing the fraction and feeding the fraction to the internal combustion engine in a regulated manner; and expanding the air and passing the expanded air to atmosphere via a filter device if the fuel tank is not closed and if the fuel tank is closed, injecting the air back into the fuel.

9. The device according to claim 2, further including a three-way or multiway valve which is regulated by means of a control unit and a control logic and has at least one outlet (A) and at least one outlet (B), the three-way or multiway valve combining the regulating device for sucking out the fraction-air mixture which has been displaced by the fuel flowing in and produced by injection with the device for generating vacuum and excess pressure.

* * * * *